United States Patent [19]

Morrison

[11] Patent Number: 4,859,115

[45] Date of Patent: Aug. 22, 1989

[54] BLADE MOUNTING APPARATUS, AND BLADE COMPRISING SAME

[76] Inventor: Donald R. Morrison, 6228 Eagle Peak Dr., Charlotte, N.C. 28214

[21] Appl. No.: 151,456

[22] Filed: Feb. 2, 1988

[51] Int. Cl.[4] ..... E01C 19/22

[52] U.S. Cl. ..... 404/112

[58] Field of Search ..... 404/112; 15/235.4; 51/177

[56] References Cited

U.S. PATENT DOCUMENTS

| | | | |
|---|---|---|---|
| 1,005,208 | 10/1911 | Heltzel | 15/235.4 |
| 2,556,983 | 6/1951 | Root | 404/112 |
| 2,662,454 | 12/1953 | Whiteman | 404/112 |
| 2,689,507 | 9/1954 | McCrery | 404/112 |
| 2,865,269 | 12/1958 | McMillan | 404/112 |
| 2,888,863 | 6/1959 | Eisenbeis | 404/112 |
| 3,375,766 | 4/1968 | Zochil | 404/112 |
| 3,683,761 | 8/1972 | Babic | 404/112 |

*Primary Examiner*—Jerome W. Massie
*Assistant Examiner*—Matthew Smith
*Attorney, Agent, or Firm*—Olive & Olive

[57] ABSTRACT

The present mounting apparatus includes a pair of retaining tabs secured to an upper surface of a blade adjacent leading corners. Each retaining tab includes a side wall, an end wall and a cover plate which forms a cavity with the blade upper surface. A pair of retaining tabs are secured to the upper surface of the blade adjacent trailing corners. The four retaining tabs cooperate to removably secure the blade to a trowel finishing blade without the use of mechanical fasteners.

4 Claims, 5 Drawing Sheets

BLADE MOUNTING APPARATUS, AND BLADE COMPRISING SAME

BACKGROUND OF THE INVENTION

1. Field of the Invention

The present invention relates generally to a mounting apparatus for removable attachment of a float blade or a combination blade to a blade assembly of a trowel.

2. Description of the Related Art

Generally, motor-powered trowels include a rotary blade assembly which engages, packs and finishes concrete, cement and the like. The blade assembly may include float blades or combination blades removably secured to each finishing blade of the blade assembly.

In conventional practice, newly poured concrete or cement is first worked with float blades, to smooth the concrete surface and achieve a uniform appearance. Simultaneously, the floating operation settles large stones and causes fine particles to rise to the surface. Thereafter, the float blades are removed from the blade assembly. The concrete then is finished with finishing blades which are standard equipment on most trowels. Conventional float blades are constructed from abrasion-resistant steel. The use of removable float blades increases the life of the finishing blade assembly. Reversible float blades are known but have not come into widespread usage.

Alternatively, a combination blade can be removably attached to the trowel blade assembly. The combination blade is utilized for both the floating and finishing operations.

Various systems have been devised to quickly mount a float blade or a combination blade on a trowel blade assembly. Prior art methods are described in the following representative U.S. Pat. Nos. 2,556,983; 2,662,454; 2,689,507; 2,865,269; 2,888,863; 2,999,261 and 3,375,766.

The art continues to seek improvements. It is desirable that a float blade or a combination blade be readily and removably mountable on a trowel finishing blade. It is desirable that a mounting system be economical to install, easy to operate and adaptable for either float or combination blades.

The present invention relates to a blade construction and to an apparatus for removably mounting a blade on a finishing blade of a trowel. The mounting apparatus is economical to install, easy to operate and adaptable for either a float blade or a combination blade. The blade construction of the invention further relates to float blades and combination blades employing the present mounting apparatus.

In a preferred embodiment, the present mounting apparatus includes a pair of retaining tabs secured to an upper surface of a blade adjacent leading corners. Each retaining tab includes a side wall, an end wall and a cover plate which forms a cavity with the blade upper surface. A second pair of retaining tabs are secured to the upper surface of the blade adjacent trailing corners. The four retaining tabs cooperate to removably secure the blade to a trowel finishing blade without the use of mechanical fasteners.

In an alternative embodiment, at least one stop element replaces the trailing retaining tabs to secure a blade on a trowel finishing blade.

DETAILED DESCRIPTION OF THE PREFERRED EMBODIMENTS

Figure 1:
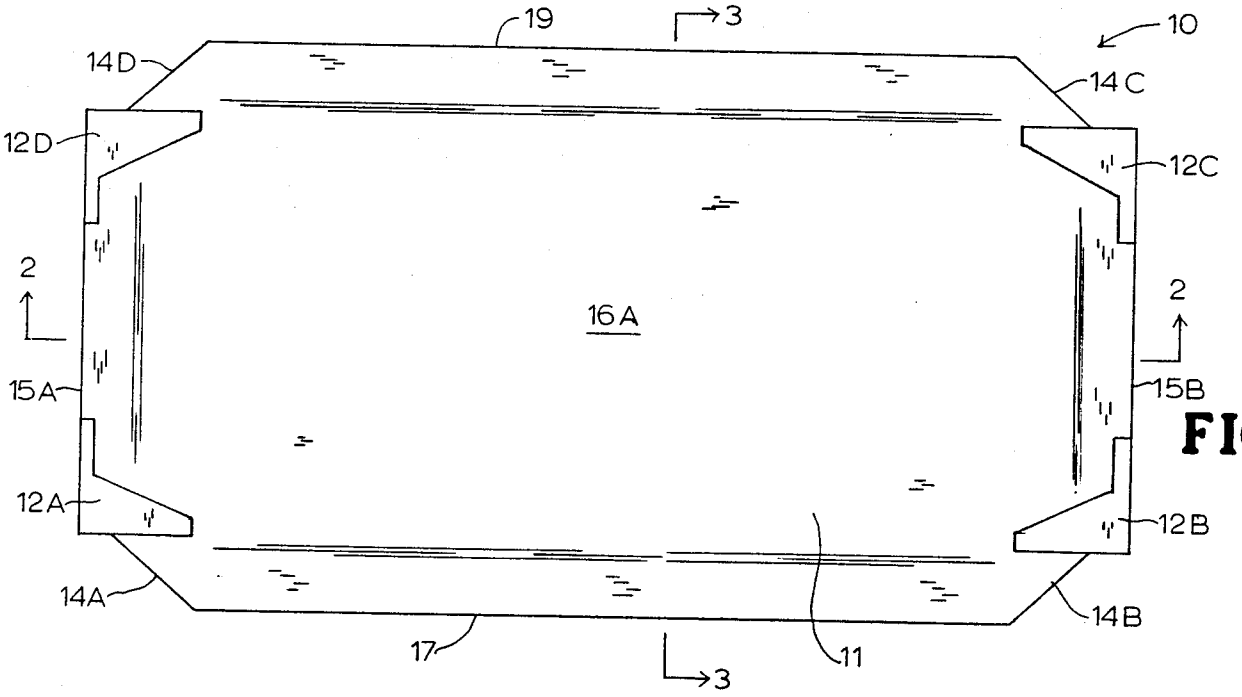
FIG. 1 is a top plan view of a float blade emplying the present mounting apparatus.
Figure 3:
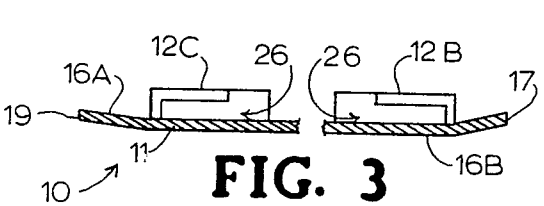
FIG. 3 is a section view taken along line 3—3 of FIG. 1.
Figure 2:
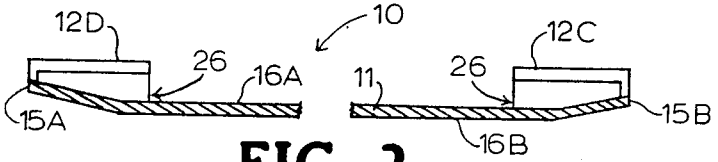
FIG. 2 is a section view taken along line 2—2 of FIG. 1.

A float blade 10 of the present invention is illustrated in FIGS. 1-3. Float blade 10 includes a generally rectangular planar member 11 having a retaining tab 12A-12D mounted at each corner 14A-14D. Float blade 10 includes an upper surface A, and a lower surface 16B which engages concrete, cement or the like. Float blade 10 also includes end edges 15A-15B, leading edge 17 and trailing edge 19. As described below, retaining tabs 12A-12D cooperate to removably secure the float blade 10 to a desired other blade.

It is desirable that float blade 10 include beveled edges 5A-5B, 17, and 19 that are slanted toward the upper surface 16A of float blade 10 as illustrated best in FIGS. 2 and 3. During the floating operation, beveled edges 15A-5B, 17 and 19 enhance the float blade's ability to smooth the upper surface of the concrete by forcing stones and rocks down into the concrete. If desired, corners 14A-14D can be formed in configurations other than ninety degrees, e.g. approximately forty five degrees as illustrated in FIGS. 14. Such "cut-off" corner configuration is advantageous in minimizing the occurrence of ridges in the concrete in the floating operation.

Figure 4:
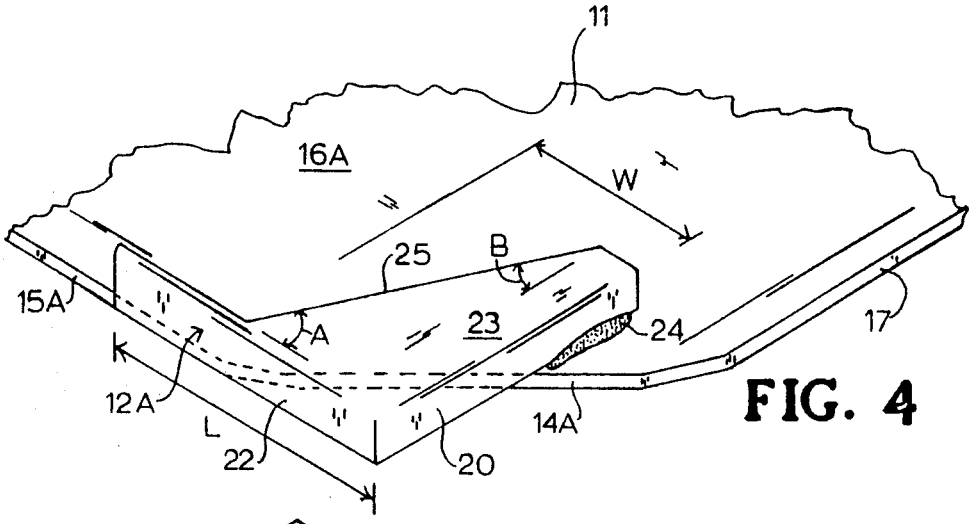
FIG. 4 is an enlarged perspective view illustrating the present retaining tab secured to the upper surface of the float blade of FIG. 1.
Figure 5:
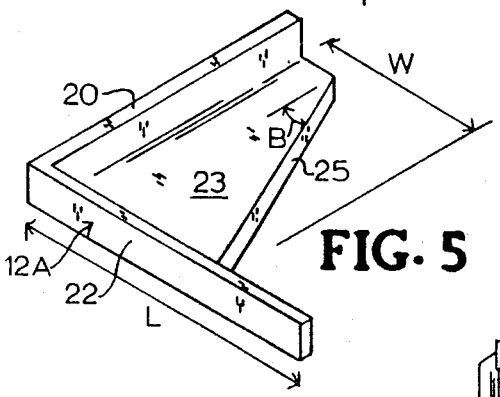
FIG. 5 is an enlarged inverted perspective rear view of the retaining tab of FIG. 4 removed from the float blade.

As illustrated best in FIGS. 4 and 5, each retaining tab 12A-12D includes a side wall 20, and end wall 22 and a cover plate 23. Preferably, retaining tab 12A is mounted on the upper surface 16A of float blade 10 so that cover plate 23 is positioned at the corner 14A of float blade 10. End wall 22 is aligned with end edge 15A. Side wall 20 is parallel to leading edge 17 and trailing edge 19. The lower portion of side wall 20 is secured to the upper surface 16A of float blade 10 by any suitable means, e.g. weld 24. Cover plate 23 is provided between side wall 20 and end wall 22 and forms a cavity 26(FIGS. 2 & 3) with the upper surface 16A of float blade 10 for receiving a blade as described below. The retaining tab side wall 20 and end wall 22 are thus generally perpendicular to one another, and the interior main edge 25 of the cover plate 23 is angularly oriented with respect to the side wall 20 and end wall 22, defining acute included angles A and B therewith.

The maximum width W of cover plate 23 is less than the length L of end wall 22 (see FIGS. 4 & 5). This feature, of L being greater than W, is a significant advantage since the finishing blades wear substantially in use, so that their The length of the end wall 22 thus provides the practical benefit that even when the finishing blade is worn down and of shortened width, the end wall still retains the float blade in place on the finishing blade, and prevents the float blade from disengaging from the trowel under the action of centrifugal force during operation.

Figure 6:
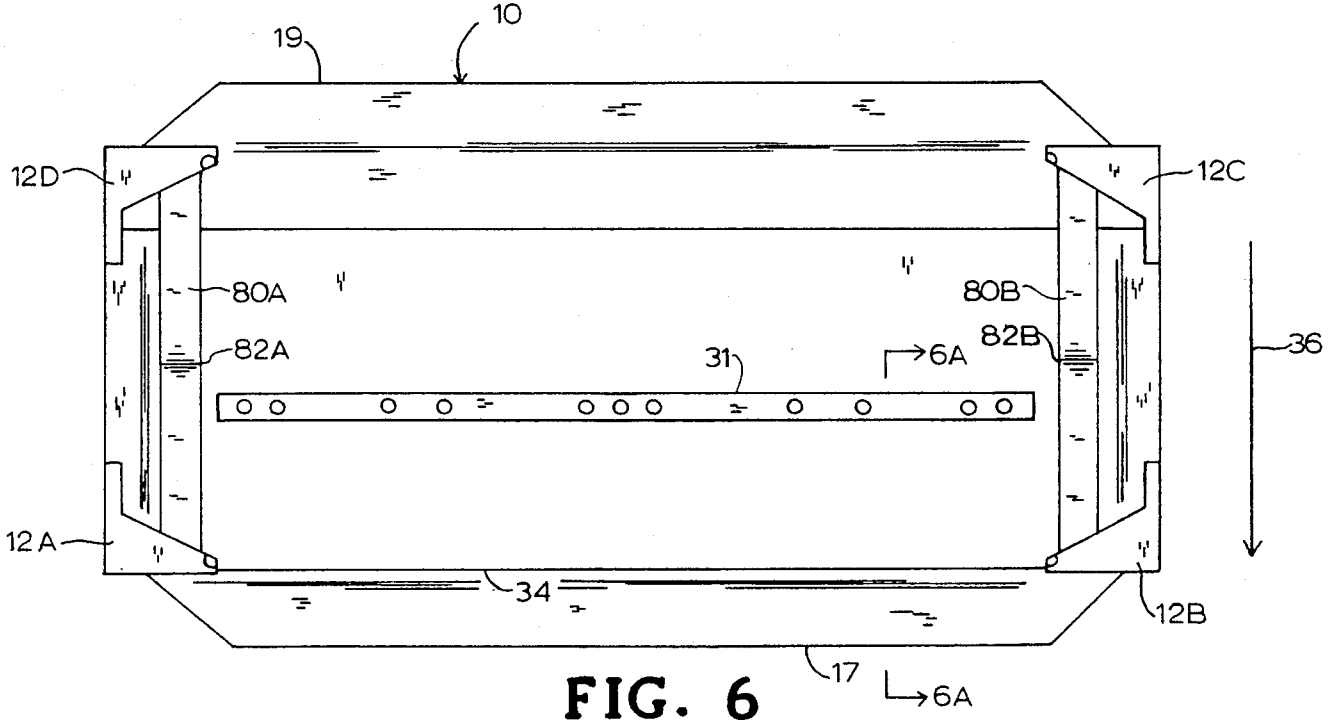
FIG. 6 a top plan view of the float blade of FIG. mounted of a trowel finishing blade.
Figure 6A:
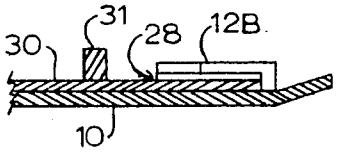
FIG. 6A is a sectional view along line 6A—6A of FIG. 6.

Side wall 20 and end wall 22 of the retaining tab are of sufficient height so that a gap 28 remains between a blade 30 received in cavity 26 and the lower surface of cover plate 23 (FIG. 6A). This gap may for example be on the order of about 1/16 inch in vertical dimension.

Figure 7:
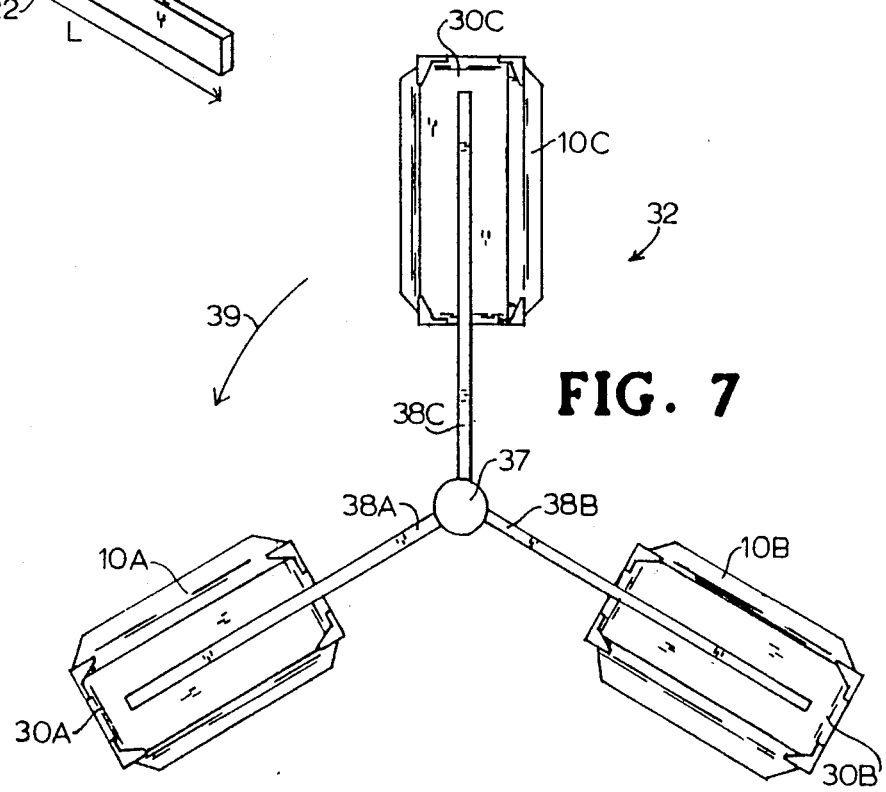
FIG. 7 is a top plan view of a trowel blade assembly mounting float blades of FIG. 1.

For installation, float blade 10 is removably secured to blade 30 (FIG. 6) of a trowel blade assembly (FIG. 7). As illustrated in FIG. 6, a leading edge 34 of blade 30 is received in the cavities 26 of retaining tabs 12A and 12B adjacent leading edge 17. Blade 30 includes a bracket 31 for mounting the blade assembly 32. As blade 30 moves in the direction of arrow 36, leading edge 34 is retained in cavities 26 by cover plates 23. As the floating operation occurs, beveled leading edge 17 and the gap 28 between blade 30 and cover plate 23 permit float blade 10 to shift and "float" over the surface of unfinished cement or concrete. As the leading edge 17 wears, float blade 10 can be quickly remounted on blade 30 so that trailing edge 19 becomes the leading edge, thereby extending the life of float blade 10.

The retaining tabs 12A–12D of the present invention are thus simple in construction and readily fabricated and employed. In contrast to various blade mounting means heretofore employed for mounting other blades on trowel finishing blades, the retaining tabs 12A–12D of the present invention are devoid of mechanical fasteners, e.g. clamps, brackets, mounting screws and the like. Accordingly, the mounting tabs 12A–12D of the invention achieve a substantial advance in the ar as regards their simplicity and ease of use.

As illustrated in FIG. 7, a typical blade assembly 32 includes three float blades 10A–10C removably mounted on respective finishing blades 30A–30C. A power shaft 37 includes three spokes 38A–38C. As the assembly 32 rotates in the direction of arrow 39, float blades C are retained on blades 30A–30C.

Figure 8:
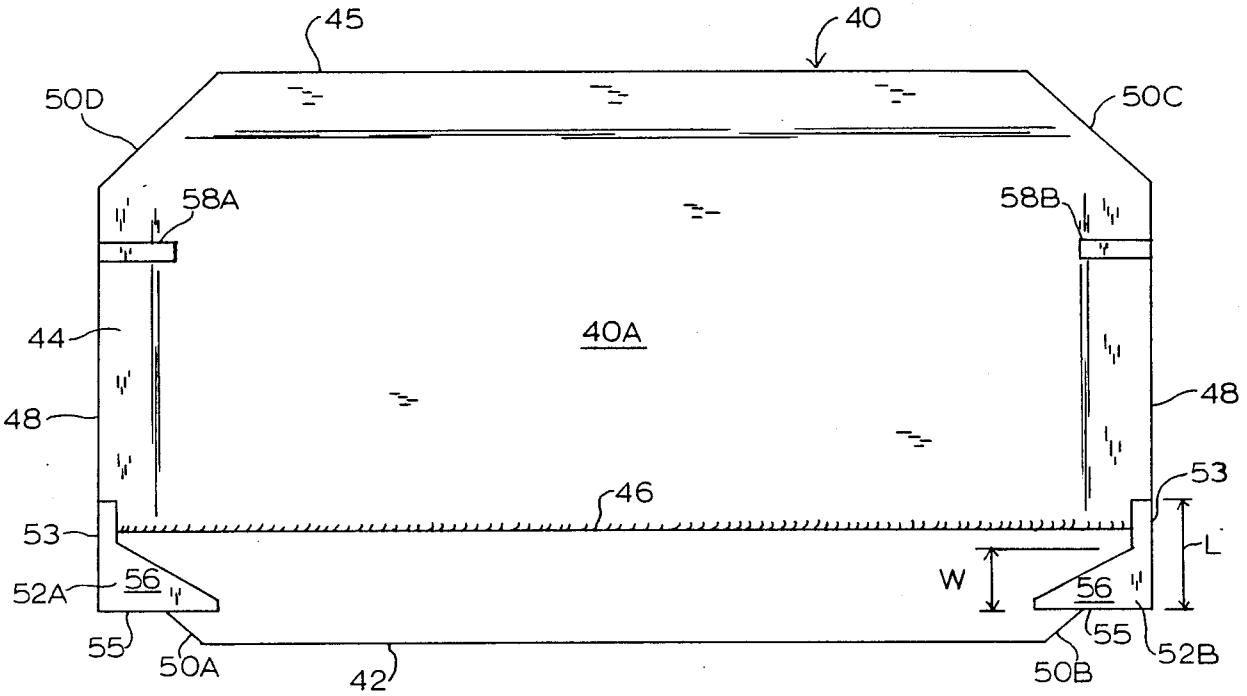
FIG. 8 is a top plan view of a combination blade employing the present mounting apparatus.
Figure 9:
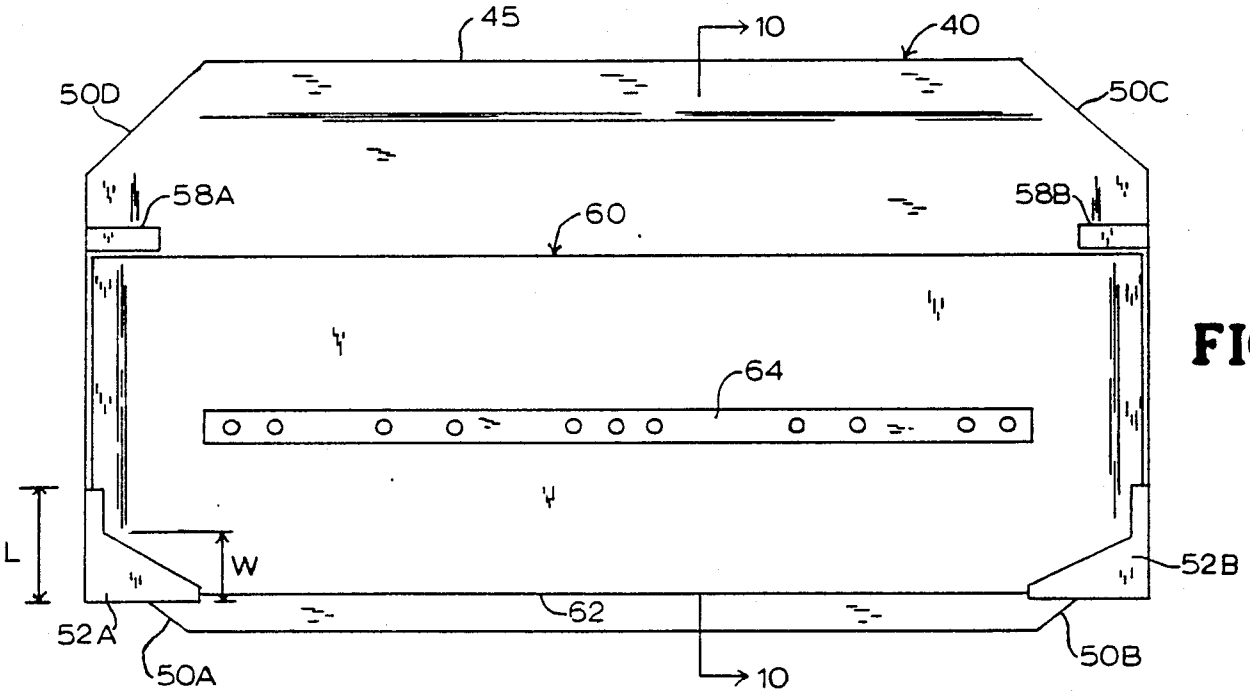
FIG. 9 is a top plan view of the combination blade of FIG. 9 on a towel finishing blade.
Figure 10:
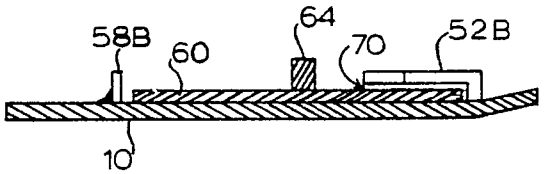
FIG. 10 is a sectional view taken along line 9 of FIG. 9.

A combination blade 40 is illustrated in FIGS. 8–10. Combination blade 40 includes a leading edge member 42 secured to a body portion 44 by any suitable manner, e.g. weld 46. Body portion 44 includes a trailing edge 45 and end edges 48. It is desirable that leading edge member 42 be constructed from a durable, abrasion-resistant steel. For example, the leading edge member 42 may be formed of a hot rolled steel while the body portion 44 is spring steel, or both the leading edge member 42 and the body portion 44 may be formed of spring steel. Leading edge member 42 and body portion 44 form a generally rectangular planar member having corners 50A–50D. It is desirable that corners 50A–50D be angled as illustrated in FIGS. 8 and 9. Furthermore, it is desirable that edges of the leading edge member 42, and the body portion edges 45 and 48 be beveled toward the upper surface 40A of plate 40.

Retaining tabs 52A and 52B, identical to retaining tabs 12A–12D described above, are secured to corners 50A and 50B by any suitable means, e.g. welding. Tabs 52A and 52B include end walls 53, side walls 55 and cover plate 56. A cavity 54, identical to cavity 26, is formed between the upper surface 40A of combination blade 40 and cover plate 56 of retaining tab 52. Preferably, the maximum width W of cover plate 56 is less than the length L of tabs 52A and 52B.

A pair of stop elements 58A and 58B are provided on the upper surface 40A of combination blade 40 and cooperate with tabs 52 to mount a finishing blade 60 of a conventional blade assembly (not illustrated). Stop elements 58A and 58B are vertical members which are secured to the upper surface 40A by any conventional means, e.g. by welding. In other embodiments, a single stop element or a plurality of stop elements can be utilized.

For installation, a leading edge 62 of a blade 60 is received in cavities 54. Stops 58A and 58B form a backstop for retaining blade 60. Blade 60 can include a bracket 64 for mounting the blade assembly 32 on a trowel.

As illustrated in FIG. 10, the height of end walls 53 and side walls 55 is sufficient so that a gap 70 remains between cover plate 56 and blade 60 after blade 60 has been received in cavity 54. Gap 70 permits combination blade 40 to shift and "float" over the surface of unfinished cement or concretes.

Although the present invention has been described with reference to preferred embodiments, persons skilled in the art will recognize that changes may be made in form and detail without departing from the spirit and scope of the invention.

I claim:

1. A blade assembly adapted to be removably mounted on a generally rectangular trowel finishing blade, the assembly comprising:

(a) a generally rectangular plate member having a leading edge, a trailing edge and a pair of end edges; and (b) a tab secured to an upper surface of the plate member at each of the four corners thereof, each tab comprising:

(i) a laterally extending side wall generally parallelly aligned with the plate member leading and trailing edges;

(ii) an end wall generally parallelly aligned with the plate member and edges; and (iii) a cover plate generally parallelly aligned with the plate member and secured to upper surfaces of the side wall and the end wall to form a cavity bounded by the side wall, end wall, plate member and cover plate, wherein the maximum width of the cover plate is less than the length of the end wall.

2. The blade assembly as specified in claim 1 wherein the cover plate includes an interior edge angularly oriented with respect to side wall so that the maximum width of the cover plate is at the intersection of the interior edge and the end wall.

3. A blade assembly adapted to be removably mounted on a generally rectangular trowel finishing blade, the assembly comprising:

(a) a generally rectangular plate member having a leading edge, a trailing edge and a pair of end edges;

(b) a tab secured to an upper surface of the plate member adjacent each corner of the leading edge, each tab comprising:

(i) a laterally extending side wall generally parallelly aligned with the plate member leading and trailing edges;

(ii) an end wall generally parallelly aligned with the plate member end edges; and (iii) a cover plate generally parallelly aligned with the plate member and secured to upper surfaces of the side wall and the end wall to form a cavity bounded by the side wall, end wall, plate member and cover plate, wherein the maximum width of the cover plate is less than the length of the end wall; and (c) at least one stop element secured to the upper surface of the plate member at a distance from the tab side wall slightly greater than the width of the trowel finishing blade.

4. The blade assembly as specified in claim 3 wherein the cover plate includes an interior edge angularly oriented with respect to side wall so that the maximum width of the cover plate is at the intersection of the interior edge and the end wall.

* * * * *

UNITED STATES PATENT AND TRADEMARK OFFICE

CERTIFICATE OF CORRECTION

PATENT NO. : 4,859,115

DATED : August 22, 1989

INVENTOR(S) : Donald R. Morrison

It is certified that error appears in the above-identified patent and that said Letters Patent is hereby corrected as shown below:

In the Abstract - line 5, before "pair" insert --second--.

Column 2, line 3, "emplying" should be --employing--.

Column 2, line 15, after "Fig." insert --1--.

Column 2, line 16, change "of" to read --on--.

Column 2, line 24, "Fig. 9" should read --Fig. 8-- and "towel" should read --trowel--.

Column 2, line 25, change "9" to read --10-10--.

Column 2, line 34, change "A" to read --16A--.

Column 2, line 41, change "5A-5B" to read --15A-15B--.

Column 2, line 44, change "15A-5B" to read --15A-15B--.

Column 2, line 50, change "Figs. 14" to read --Figs. 1-4--.

Column 3, line 7, after "their" insert --widths (i.e., dimension in the direction parallel to arrows W and L in Figure 4) become substantially reduced with time.--

Column 3, line 20, after "assembly" insert --32--.

UNITED STATES PATENT AND TRADEMARK OFFICE

CERTIFICATE OF CORRECTION

PATENT NO. : 4,859,115

DATED : August 22, 1989

INVENTOR(S) : Donald R. Morrison

It is certified that error appears in the above-identified patent and that said Letters Patent is hereby corrected as shown below:

Column 3, line 42, change "ar" to read --art--.

Column 3, line 49, change "C" to read --10A-10C--.

Column 4, line 47, change "and" to read --end--.

Signed and Sealed this

Twelfth Day of June, 1990

*Attest:*

HARRY F. MANBECK, JR.

*Attesting Officer*

*Commissioner of Patents and Trademarks*